US008282314B2

(12) United States Patent
Masaki et al.

(10) Patent No.: US 8,282,314 B2
(45) Date of Patent: Oct. 9, 2012

(54) HAMPERING MOTION FLOATING STRUCTURE

(75) Inventors: Takayuki Masaki, Osaka (JP); Masahide Miyoshi, Osaka (JP)

(73) Assignee: Taiyo Kogyo Corporation, Osaka (JP)

( * ) Notice: Subject to any disclaimer, the term of this patent is extended or adjusted under 35 U.S.C. 154(b) by 0 days.

(21) Appl. No.: 12/980,778

(22) Filed: Dec. 29, 2010

(65) Prior Publication Data

US 2011/0236139 A1 Sep. 29, 2011

(30) Foreign Application Priority Data

Mar. 26, 2010 (JP) ..... 2010-072061

(51) Int. Cl.
*B63G 9/04* (2006.01)
*E02B 15/04* (2006.01)

(52) U.S. Cl. .... 405/63; 114/241; 114/240 C; 114/240 E

(58) Field of Classification Search ..... 405/63, 405/64; 114/240 R, 241, 240 A, 240 C, 240 E
See application file for complete search history.

(56) References Cited

FOREIGN PATENT DOCUMENTS

JP 01192909 A * 8/1989
JP H02-115791 9/1990

* cited by examiner

*Primary Examiner* — Sunil Singh
(74) *Attorney, Agent, or Firm* — Michael A. Glenn; Glenn Patent Group

(57) ABSTRACT

A floating structure includes a water pollution preventing membrane having a float part extending so as to define a water area, and a curtain part suspended at a lower end of the float part to define the water area in water. A float net having floatable ropes anchored to the float part and knitted into a lattice with a predetermined mesh size is disposed in an outer water area defined by the water pollution preventing membrane. Of the ropes constituting the float net, the rope which is disposed in parallel to the float part has a light reflection rope and a support rope for supporting a trap net suspended into water. The propeller of a watervehicle moved into the float net is caught by part of the ropes or the trap net to prevent the watervehicle from approaching the water pollution preventing membrane or an inner water area.

8 Claims, 5 Drawing Sheets

HAMPERING MOTION FLOATING STRUCTURE

CROSS REFERENCES TO RELATED APPLICATION

This application claims the benefit of Japanese Patent Application No. 2010-072061 filed on Mar. 26, 2010 and including specification, claims, drawings and summary. The disclosure of the above Japanese Patent Application is incorporated herein by reference in its entirety.

FIELD

The present invention relates to a hampering motion floating structure, and, more particularly, to a hampering motion floating structure which has a floating body membrane structure laid out to define part of a sea area and can prevent a moving watervehicle from colliding with the floating body membrane structure.

BACKGROUND

To prevent a watervehicle from approaching and colliding with a structure, such as a offshore drilling rig or an artificial island, constructed at sea, conventionally, display buoys or the like are spread on the surface of water in a warning water area set around the structure. Such a display buoy alone cannot continuously define and show a warning water area. In case of overlooking such a display buoy, therefore, a watervehicle is likely to enter the warning water area and collide with or contact a marine structure.

As a solution to the problem, a watervehicle intrusion preventing fence which defines a warning water area around a marine structure in a line has been proposed in Unexamined Japanese Utility Model Application KOKAI Publication No. H2-115791. This fence includes elongated beltlike floating bodies disposed at a sea surface concentrically around a marine structure, a net laid out between the beltlike floating bodies, and anchor which fixes the beltlike floating bodies and the net.

According to the watervehicle intrusion preventing fence, the bow of a watervehicle hits the beltlike floating bodies to be caught, or the propeller of the watervehicle is caught with the laid-out net, so that the anchor is dragged to decelerate or stop the watervehicle.

Water pollution (turbid) which is caused by stirring a sea soil picked up in a dredging work or reclamation work which is carried out at sea or the like may enter gills of fishes to cause respiratory distress and reduce the illuminance in water to adversely affect benthic creatures. To overcome those problems, a water pollution preventing membrane which includes a floating body membrane structure is used as a structure which is laid out to prevent diffusion of water pollution. The layout of this water pollution preventing membrane can physically prevent diffusion of water pollution (turbid) which occurs in a dredging work or reclamation work carried out at sea or river.

The watervehicle intrusion preventing fence disclosed in Unexamined Japanese Utility Model Application KOKAI Publication No. H2-115791 is premised on navigation of a large ship and is intended to prevent intrusion of such a ship with the fence. A meshed net is planarly laid out near a sea surface. Depending on the mesh size of the net, therefore, when a ship passes over the net, the bottom of the ship may push down the entire net. As a result, the propeller of the ship may pass over the net, or the eddy produced around the propeller may push away the net so that the ship enters the warning water area.

Large ships are not navigated in a sea area where the water pollution preventing membrane is located. Therefore, the shock resistance of the floating body of the floating body membrane structure prevents damage or the like from being caused by collision of a small watervehicle. To improve the safety of a floating body membrane structure, however, it is necessary to prevent collision of a watervehicle with the floating body beforehand.

SUMMARY

Accordingly, it is an object of the present invention to provide a hampering motion floating structure which overcomes the inherent problems of the related arts, and surely prevents a watervehicle from approaching a floating body membrane structure, making it possible to inhibit movement of a watervehicle approaching a water pollution preventing membrane.

To achieve the object, a hampering motion floating structure according to one aspect of the invention includes a water pollution preventing membrane having a float part extending so as to define a water area, and a curtain part suspended at a lower end of the float part to define the water area in water, a float net including a net having floatable ropes knitted into a lattice with a predetermined mesh size, and a trap net suspended from the ropes, the nets being attached to the float part and spread on an outer water area defined by the water pollution preventing membrane, the floatable ropes and the trap net of the hampering motion floating structure is configured to tangle with the propulsion mechanism of a watervehicle having approached the hampering motion floating structure.

The ropes constituting the float net preferably have a light reflection rope and a support rope for supporting the trap net.

The light reflection rope and the support rope are preferably disposed in parallel to the float part.

It is preferable that the light reflection rope should have a rope twisted with a thin stringlike reflective film, thereby enhancing the visibility.

It is preferable that the trap net should extend in a lengthwise direction of the support rope, and should be suspended into water by a length substantially equal to the mesh size of the float net. Accordingly, after the support rope is entangled with the propeller shaft, the propeller can be covered with the trap net.

It is preferable that the support rope should be provided with a floating body to compensate for a weight of the trap net suspended from the ropes, so that the support rope can maintain the buoyancy and stability.

It is preferable that the light reflection rope and the support rope should be arranged alternately to form a warp rope. This can ensure enhanced visibility and efficiently suppress approaching of watervehicles.

It is preferable that the water pollution preventing membrane should have a flash light having a solar cell battery as a power source, provided at the float part, thereby enhancing the visibility.

According to the invention, the water pollution preventing membrane is provided with highly visible components, and the float net has a lattice net formed of highly visible ropes with a large mesh size, bringing about a warning effect of preventing a small watervehicle from approaching the layout range of the float net and an effect of catching the propeller of a small watervehicle moved to the float net with the ropes of the float net, so that the watervehicle can be surely stopped at seat before reaching the water pollution preventing membrane or so.

BRIEF DESCRIPTION OF THE DRAWINGS

A more complete understanding of this application can be obtained when the following detailed description is considered in conjunction with the following drawings, in which.

DETAILED DESCRIPTION

A mode of carrying out a hampering motion floating structure according to the present invention will now be described by way of embodiment given below with reference to the accompanying drawings.

Embodiment

Figure 1A:
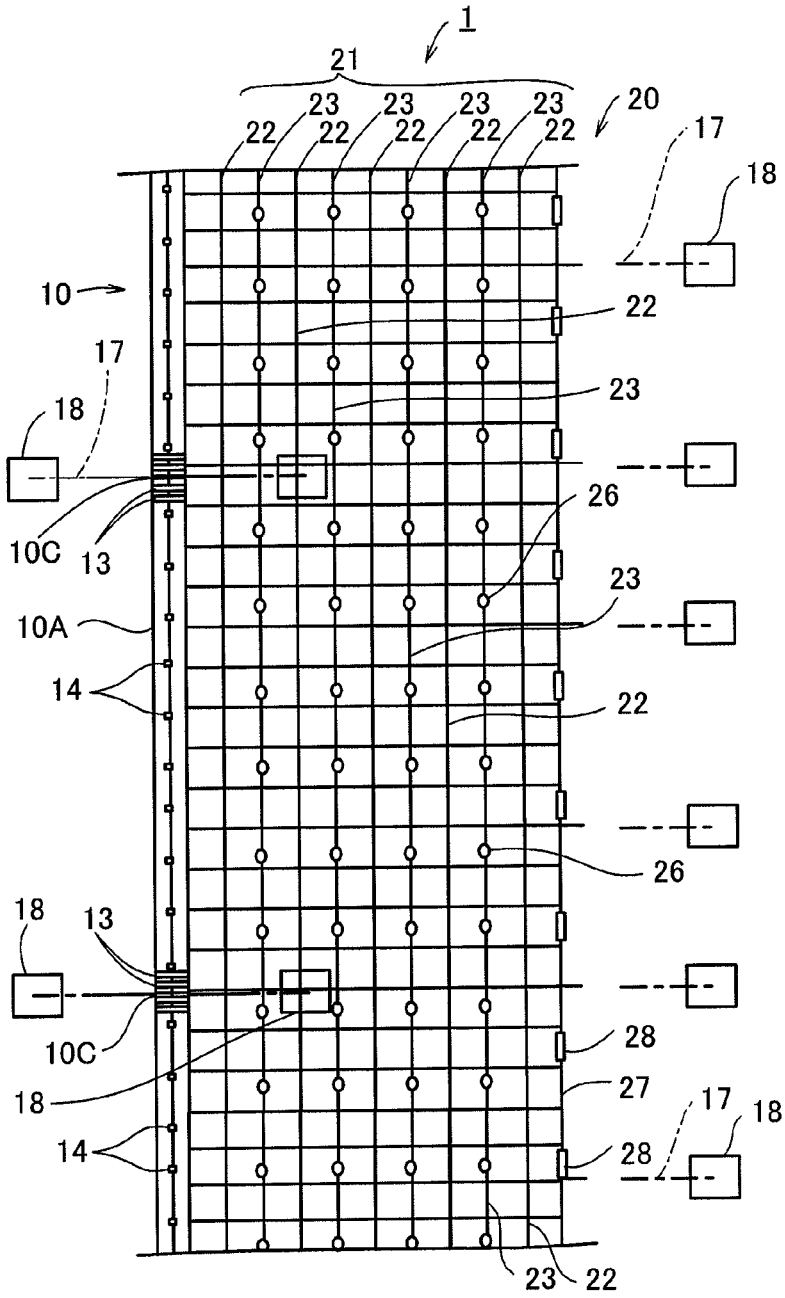
FIG. 1A is a partial plan view of a hampering motion floating structure according to one embodiment of the invention.
Figure 1B:
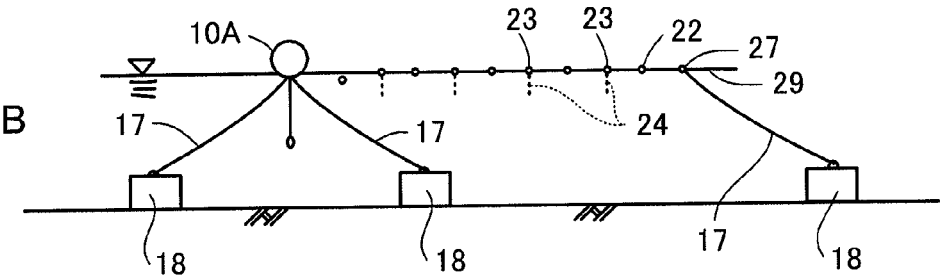
FIG. 1B is side view of a hampering motion floating structure according to one embodiment of the invention.
Figure 2:
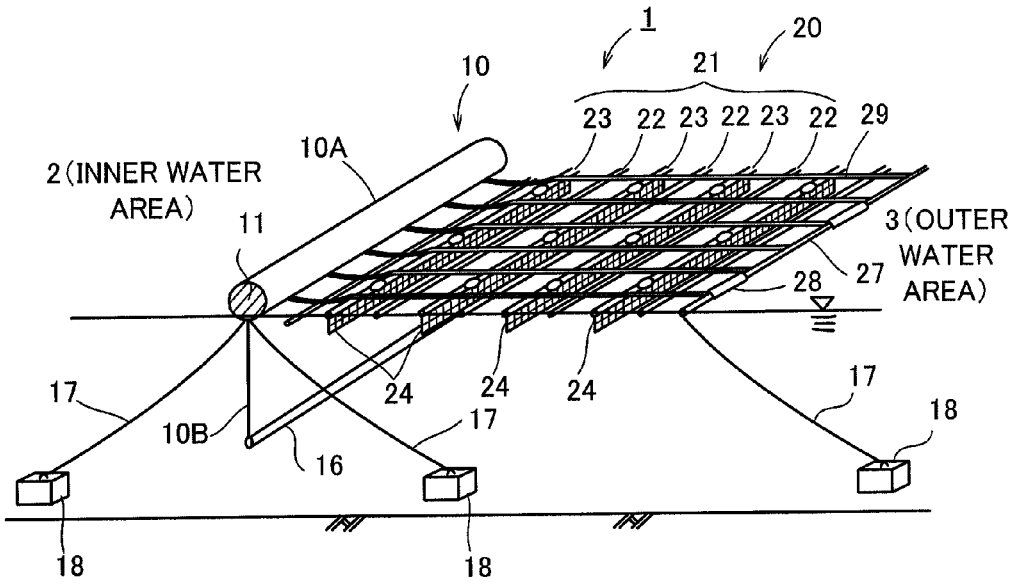
FIG. 2 is a partial perspective view three-dimensionally showing the general structure (water pollution preventing membrane and float net) of the hampering motion floating structure shown in FIGS. 1A and 1B for explanation thereof.

FIG. 1A is a partial plan view showing a part of a hampering motion floating structure 1 according to the invention, and FIG. 1B is a cross-sectional view thereof. FIG. 2 is a perspective view three-dimensionally showing a part of the hampering motion floating structure 1 shown in FIGS. 1A and 1B. This hampering motion floating structure 1 defines an inner water area (e.g., 2 reclamation work area) and an outer water area, and prevents diffusion of pollutant water from the inner water area to the outer water area. The hampering motion floating structure 1 includes a water pollution preventing membrane 10 which has a fence function of inhibiting intrusion of watervehicles into the inner water area, and a float net 20 which prevents watervehicles from approaching the water pollution preventing membrane 10.

Figure 3:
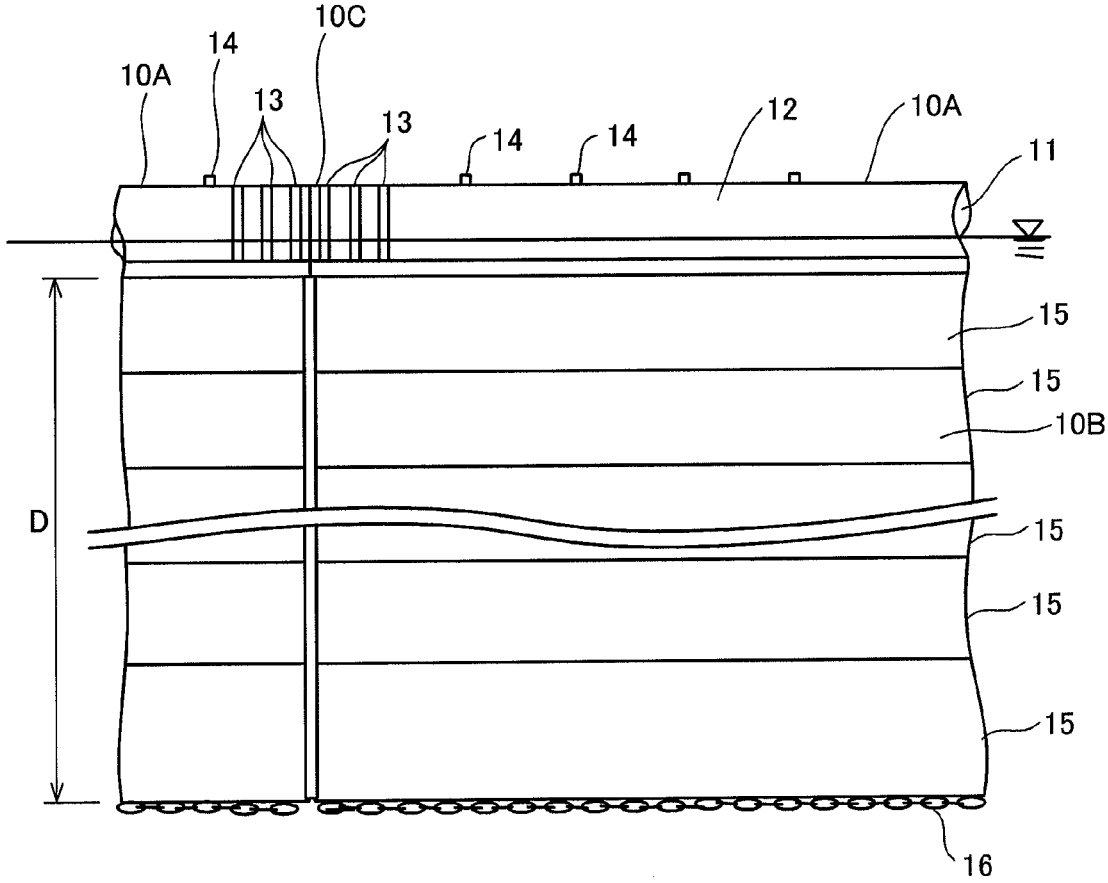
FIG. 3 is a front view showing in enlargement the structure of the water pollution preventing membrane.

The structure of the water pollution preventing membrane 10 will be described with reference to FIG. 4 in addition to the aforementioned drawings. As the water pollution preventing membrane 10 has a buoyancy member 11, it is placed at a sea surface. The water pollution preventing membrane 10 has float parts 10A which define an inner water area 2 (e.g., reclamation work area) and an outer water area 3, and curtain parts 10B which are suspended into water from the float parts 10A to inhibit diffusion of pollutant water, produced in the inner water area 2, in water. The float part 10A has the buoyancy member 11 and a float cover 12 which covers the outer surface of the buoyancy member 11. A water proof sheet which has a high-strength polyester synthetic fiber fabric base coated with high-strength polyester tarpaulin having ultraviolet resistance is used for the float cover 12 and the curtain part 10B. A cylindrical foam material such as foamable polystyrene is used for the buoyancy member 11 inside the float part 10A. As shown in FIG. 3, the curtain part 10B having a curtain length (depth) D is suspended from the float part 10A. The curtain length (depth) D is determined by design in consideration of the diffusion state of a pollution layer. For instance, the curtain length (depth) D is substantially equal to the mesh size of the float net 20 to be described later. The curtain part 10B is formed by joining prevention sheets 15 with a predetermined raw fabric width in the depth direction. A weight chain 16 is attached to the lower end of the curtain part 10B along the lengthwise direction. This allows the curtain part 10B to be held suspended in sea water, thus preventing the curtain part 10B from being turned up or around due to the influence of from the tidal current or the like. According to the embodiment, the water pollution preventing membrane 10 has one span (vertical length in FIGS. 1A and 1B) of 20 m. The water pollution preventing membrane 10 is anchored to concrete anchor blocks 18 at the bottom of the sea by anchor ropes 17 every span (FIG. 1B and FIG. 2).

When the water pollution preventing membrane 10 is used near a rock reef, the coating with the aforementioned polyester tarpaulin does not provide sufficient wear resistance. It is therefore preferable coat the float part 10A with a conveyor belt of synthetic rubber. Likewise, the curtain part 10B is formed by a conveyor belt. This can improve the wear resistance to prevent damages on the float cover 12 from being damaged, flying of the buoyancy member 11, damages on the curtain part 10B, fall-off of the weight chain 16, etc. which are caused by rubbing against the rock reef.

To improve the visibility from a watervehicle moving near the water pollution preventing membrane 10, a beltlike light reflection tape 13 is wound around a joint 10C of the individual float parts 10A. Further, light emitting devices, such as flash lights, are attached to the float part 10A in the lengthwise direction thereof at predetermined pitches. Since the flash light 14 emits light on a solar cell battery (not shown), it can be used as a maintenance-free device. The demonstration experiments conducted on the colors of lights emitted from the flash lights 14 show that green, red and yellow are excellent for visibility at night. It is therefore preferable to use lights of those colors for the flash lights 14. When the color of light of a navigation aid at the site of the hampering motion floating structure 1 is set, it is preferable to set the emission color of the flash light 14 as specified.

The float net 20 is a net body which has plural kinds of ropes (to be described later) knitted into a net with a predetermined mesh size. The ropes used for the float net 20 are formed of floatable materials. Of the inner water area 2 (e.g., reclamation work area) and the outer water area 3 (watervehicle-approaching side) defined by the water pollution preventing membrane 10, the outer water area 3 has a predetermined width (horizontal length in FIGS. 1A and 1B). One side of the float net 20 is anchored to the lower end of the float part 10A to be integral with the water pollution preventing membrane 10. The float net 20 is formed into a lattice with a width (horizontal length in FIGS. 1A and 1B) of 10 m and a mesh size of about 1 m.

A description will be given of a plurality of warp ropes 21 parallel to the in the lengthwise direction of the float part 10A and a plurality of weft ropes 29 orthogonal to the warp ropes 21, both constituting the float net 20. As shown in FIG. 1A and FIG. 2, the warp rope 21 is formed by alternate layout of light reflection ropes 22, and support ropes 23 which suspend trap nets 24. The light reflection rope 22 is formed by a synthetic fiber twisted rope twisted with a thin metal coating film. This metal coating film is twisted in the synthetic fiber twisted rope in such a way as to continuously appear at the rope surface along the strand of the rope. When light hits the light reflection rope 22, the metal coating film formed on the surface of the light reflection rope 22 reflects the light, so that the whole light reflection rope 22 appears shiny. As observed from a moving watervehicle at night, therefore, the light reflection ropes 22 in the plurality of warp ropes 21 present in the moving direction are illuminated with the headlamp or the like of the watervehicle, and are looked shiny in line. Further, light is emitted from the flash lights 14 provided at the top end of the float part 10A of the water pollution preventing membrane 10. This can permit the water pollution preventing membrane 10 located ahead and the float net 20 located in front thereof to be surely visible from the watervehicle.

Since the water pollution preventing membrane 10 and the float net 20 are essentially formed of synthetic fibers and synthetic resin, the initial cost can be suppressed comparatively low.

Instead of the light reflection rope 22, a retroreflective rope having a thin tape with a string of micro beads twisted therein or wound thereon, a light storing rope which absorbs light energy from the sun, an illumination device or so and emits light (is excited) or the like is available. Since the light reflection rope to be adhered to the float part 10A is often adhered directly to the buoyancy member, it is preferable to use an adhesive light reflection sheet or the like which contains retroreflective reflection material.

A plurality of long cylindrical foam floats 28 are attached to an end rope 27 of the float net 20. This makes it possible to stabilize the whole float net 20 against sea waves which hit the end portion of the float net 20.

The weft ropes 29 are weaved with the respective warp ropes 21 into a lattice. The weft rope 29 is formed by a floatable polyester rope. Because the warp ropes 21 and the weft ropes 29 are formed of floatable materials, the whole float net 20 floats at a sea surface. In addition, the anchor ropes 17 are tied to the end rope 27 of the float net 20 at predetermined pitches. The float net 20 is anchored to the concrete anchor blocks 18 at the bottom of the sea via the anchor ropes 17 (FIG. 1B and FIG. 2).

Figure 4:
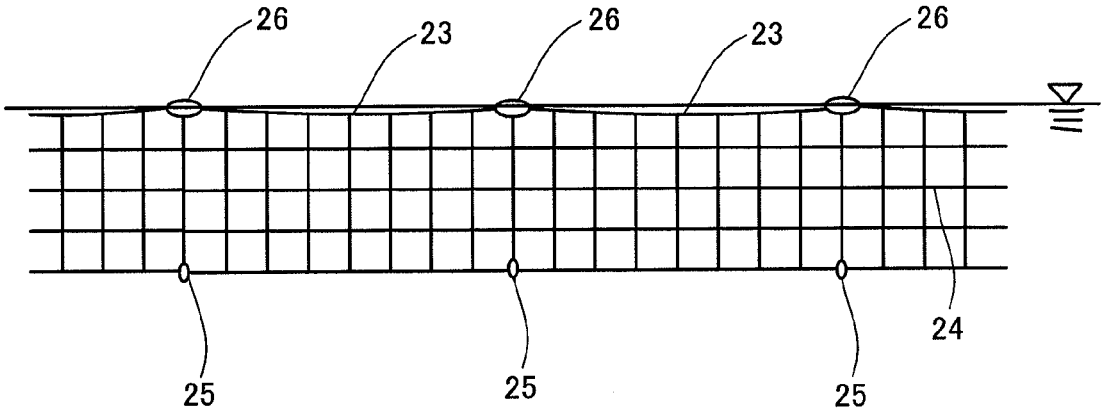
FIG. 4 is a front view showing in enlargement the structures of a trap net and a support rope.

The top end of the trap net 24 is connected with the support rope 23 which is a part of the warp ropes 21, as shown in FIG. 4. According to the embodiment, the latticelike trap net 24 having small-diameter ropes twisted with one another with a mesh size 0.25 m is suspended to a depth of about 1 m from the surface of the water. Weights 25 are attached to the lower end of the trap net 24 at predetermined pitches. Accordingly, the trap net 24 is held stretched in water. Floating bodies 26 each formed by a small foam float are attached to the support rope 23 in the lengthwise direction of the support rope 23 at predetermined pitches. The size and the quantity of the floating bodies 26 are adjusted so as to provide buoyancy that can cause the trap net 24 suspended from the support rope 23 in the sea and the weights 25 to float.

[Function of Float Net of Hampering Motion Floating Structure]

As mentioned above (also see FIG. 1A and FIG. 2), the hampering motion floating structure 1 according to the invention has the water pollution preventing membrane 10 and the float net 20 formed integral with each other. Therefore, the hampering motion floating structure 1 can decelerate and stop a watervehicle approaching the water pollution preventing membrane 10 by the float net 20. The function of the float net 20 will be described referring to FIGS. 5A to 5C.

Figure 5A:
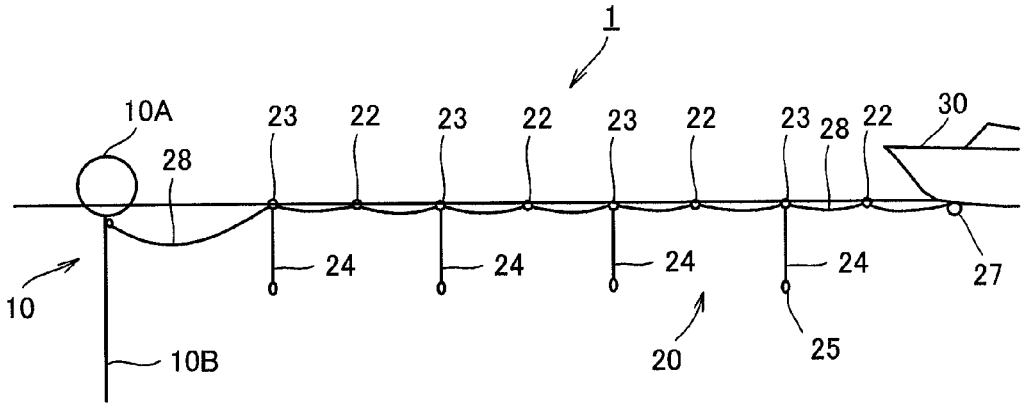
FIGS. 5A to 5C are explanatory diagrams illustrating the function of the trap net when a watervehicle moves over the float net.
Figure 5B:
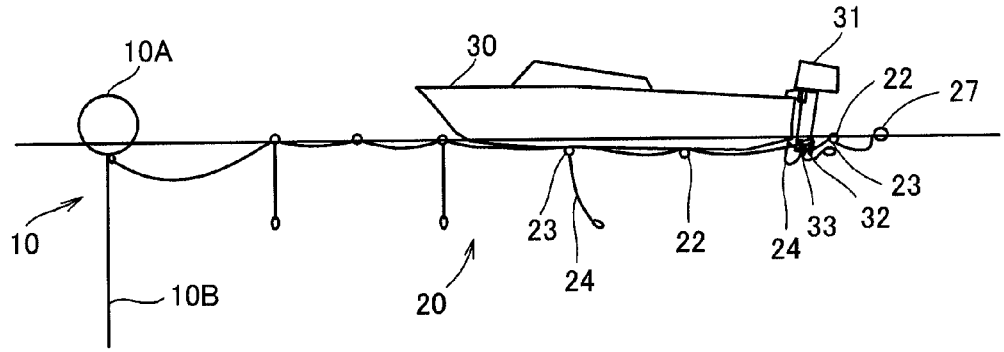
Figure 5C:
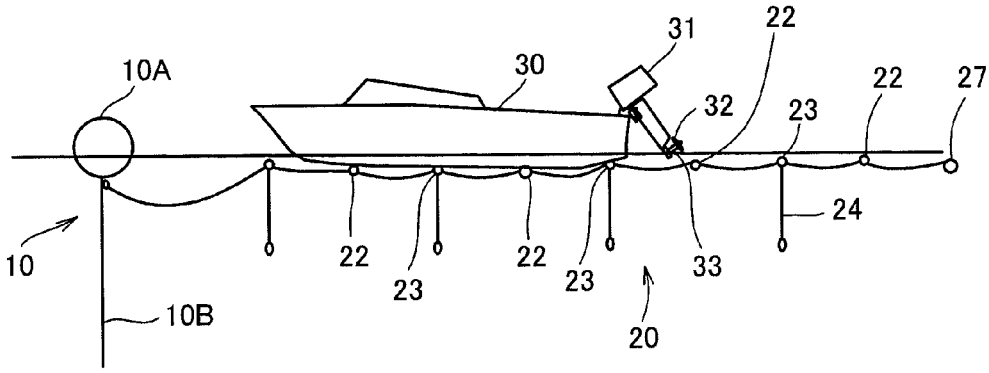

FIG. 5A shows a state where a watervehicle with an outboard engine 31, which is in motion, is approaching the position of the anchor rope 17 of the float net 20 of the hampering motion floating structure 1. Here, the watervehicle is shown as a boat 30. This boat 30 moves with its bottom sliding over the float net 20 as shown in FIG. 5B. When the position of a propeller 32 of the outboard engine 31 reaches the end rope 27, the end rope 27 twists around the propeller 32 and a propeller shaft 33. The propeller 32 and the propeller shaft 33 constitute a propulsion mechanism. If the speed of the boat 30 is equal to or greater than a certain speed, the end rope 27 is pushed down by the bottom of the boat 30 and is temporarily sunk. As a result, the end rope 27 does not twist around the propeller 32 or the like, and the boat 30 moves over the end rope 27. When the boat 30 moves over the float net 20, however, its contact with the float net 20 reduces the speed of the boat 30. Then, the light reflection rope 22 or the support rope 23 which follows the end rope 27 twists around the propeller shaft 33 or the like. As a result, the rotation of the propeller shaft 33 winds up the trap net 24 suspended from the support rope 23. The wound-up trap net 24 covers the propeller 32. Accordingly, the boat 30 completely loses the propelling means, and halts. The hampering motion floating structure 1 according to the embodiment can also stop the motion of the boat 30 which is moving with the outboard engine 31 tilted up as shown in FIG. 5C in order to avoid twisting of ropes or the like around the propeller shaft 33. That is, when the boat 30 moves over the float net 20, the bottom of the boat 30 contacts the float net 20. As a consequence, the float net 20 resists the movement of the boat 30, reducing the speed thereof. Eventually, the boat 30 halts on the float net 20. According to the hampering motion floating structure 1 of the invention, therefore, the light reflection rope 22 or the support rope 23 twists around the propeller 32 or the propeller shaft 33, and the trap net 24 can cover the propeller 32 entirely, making it possible to surely inhibit a watervehicle such as the boat 30 from approaching the water pollution preventing membrane 10.

The invention is not limited to the foregoing embodiment, and may be modified in various ways within the scope of the appended claims.

Although the description of the foregoing embodiment has been given of the case where the light reflection ropes 22 are arranged in parallel to the lengthwise direction of the float part 10A, for example, the light reflection ropes 22 may be arranged orthogonal to the lengthwise direction of the float part 10A.

Further, in the embodiment, a boat 30 with an outboard engine is described by way of example, wherein, the width (horizontal length in FIGS. 1A and 1B) of the float net 20 is 10 m. In consideration of the sizes and the speeds of watervehicles moving near the site of the hampering motion floating structure 1, however, the width of the float net 20 may be set greater so that such a watervehicles can be stopped or sufficiently decelerated with the float net 20.

In addition, the float part 10A of the water pollution preventing membrane 10 may be structured to have the buoyancy member 11 coated with a fiber reinforced plastic (FRP) resin. This can enhance the strength of the float part 10A, so that even if a watervehicle hits the float part 10A, it is possible to prevent the float part 10A from being damaged.

The description of the foregoing embodiment has been given of the structure that stops a watervehicle which is going to enter the inner water area 2 from the outer water area 3 by mistake. The installation of the foregoing hampering motion floating structure 1 is effective even in a case of stopping a watervehicle which will intentionally enter the inner water area 2. It is to be noted that spikes or barbed wires may be mounted to the outer periphery of the float part 10A to surely prevent intrusion of watervehicles.

As apparent from the above, it is intended that embodiments which can be obtained by combining technical means adequately modified within the scope of the appended claims be construed as belonging to the technical scope of the invention.

Various embodiments and changes may be made thereunto without departing from the broad spirit and scope of the invention. The above-described embodiment is (embodiments are) intended to illustrate the present invention, not to limit the scope of the present invention. The scope of the present invention is shown by the attached claims rather than the embodiment. Various modifications made within the meaning of an equivalent of the claims of the invention and within the claims are to be regarded to be in the scope of the present invention.

What is claimed is:

1. A hampering motion floating structure comprising:

a water pollution preventing membrane having a float part extending so as to define a water area, and a curtain part suspended at a lower end of the float part to define the water area in water; and a float net including a net having floatable ropes knitted into a lattice with a predetermined mesh size, and a trap net suspended from one of the floatable ropes, the float net being attached to the float part and spread on an outer water area defined by the water pollution preventing membrane, wherein the floatable ropes and the trap net of the hampering motion floating structure is configured to tangle with the propulsion mechanism of a water vehicle having approached the hampering motion floating structure.

2. The hampering motion floating structure according to claim 1, wherein the floatable ropes have a light reflection rope and a support rope for supporting the trap net.

3. The hampering motion floating structure according to claim 2, wherein the light reflection rope and the support rope are disposed in parallel to the float part.

4. The hampering motion floating structure according to claim 3, wherein the trap net extends in a lengthwise direction of the support rope, and is suspended into water by a length substantially equal to the mesh size of the float net.

5. The hampering motion floating structure according to claim 2, wherein the light reflection rope has a rope twisted with a thin stringlike reflective film.

6. The hampering motion floating structure according to claim 2, wherein the support rope is provided with a floating body to compensate for a weight of the trap net suspended from the floatable ropes.

7. The hampering motion floating structure according to claim 2, wherein the light reflection rope and the support rope are arranged alternately to form warp ropes.

8. The hampering motion floating structure according to claim 1, wherein the water pollution preventing membrane has a flash light provided at the float part, the flash light having a solar cell battery as a power source.

* * * * *